US006659326B2

(12) United States Patent
Huang

(10) Patent No.: US 6,659,326 B2
(45) Date of Patent: Dec. 9, 2003

(54) WASHER SUPPLY DEVICE ON A POWER NAILER

(75) Inventor: Chen-Fa Huang, Taichung Hsien (TW)

(73) Assignee: Besco Pneumatic Corp., Taichung Hsien (TW)

( * ) Notice: Subject to any disclaimer, the term of this patent is extended or adjusted under 35 U.S.C. 154(b) by 0 days.

(21) Appl. No.: 10/390,000

(22) Filed: Mar. 18, 2003

(65) Prior Publication Data

US 2003/0173392 A1 Sep. 18, 2003

Related U.S. Application Data

(63) Continuation-in-part of application No. 09/765,565, filed on Jan. 22, 2001, now abandoned.

(51) Int. Cl.[7] ..... B25C 7/00

(52) U.S. Cl. ..... 227/18; 227/15; 227/119; 227/136

(58) Field of Search ..... 227/18, 15, 119, 227/120, 136, 138; 221/197, 198, 297, 289

(56) References Cited

U.S. PATENT DOCUMENTS 3,595,460 A * 7/1971 Pitkin ..... 227/130
5,056,684 A * 10/1991 Beach et al. ..... 227/120
6,065,660 A * 5/2000 Cabrera ..... 227/18
6,098,442 A * 8/2000 Walldorf et al. ..... 227/15
6,273,315 B1 * 8/2001 McGuinness et al. ..... 227/18
6,302,310 B1 * 10/2001 Lamb ..... 227/119
6,481,610 B1 * 11/2002 Liu et al. ..... 227/15
6,543,666 B1 * 4/2003 Huang ..... 227/18

* cited by examiner

*Primary Examiner*—Scott A. Smith
(74) *Attorney, Agent, or Firm*—Rosenberg, Klein & Lee

(57) ABSTRACT

A washer supply device includes a hollow tubular member connected to a side of a power nailer and an opening is defined longitudinally through the tubular member. A washer transferring member is connected to the power nailer a hole is defined through the washer transferring member. A plurality of washers each have a central hole and a flexible wire frictionally extends through the central holes to collect the washers together so that the washers are received in the tubular member via the opening. The wire is pulled out from the washers via the hole in the washer transferring member. A pushing rod movably connected to the tubular member compresses on the washers and includes an outer portion for pressing on a flange of each washer, and an inner portion which is engaged with an annular groove in each washer.

1 Claim, 7 Drawing Sheets

WASHER SUPPLY DEVICE ON A POWER NAILER

This is a Continuation-In-Part application of the applicant's former U.S. Pat. No. 09/765,565, filed Jan. 22, 2001 now abandoned.

FIELD OF THE INVENTION

Background of the Invention

A conventional washer supply device for a power nailer 12 is shown in FIGS. 1 and 2 and generally includes a retaining tube 13 connected to a side of the power nailer 12 and a pushing rod 150 extends through the retaining tube 13. A spring 15 is connected to the pushing rod 150 and a engaging head 151 is connected to a lower end of the pushing rod 150. A washer transferring member 14 connected to a nose 120 of the nailer 12 and a tubular casing 11 is engaged between the retaining tube 13 and the washer transferring member 14. A plurality of washers 10 are piled in the tubular casing 11 and the washers 10 can be transferred to the nose 120 so as to be work with the nails ejected from the nose 120. The washers 10 are pressed downward by the engaging head 151 and the tubular casing 11 is made of stiff material so that when some of the washers 10 are jammed in the tubular casing 11, the tubular casing 11 has to be discarded. The tubular casing 11 cannot be reused again so that it is a huge waste and the cost for the tubular casings 11 are expensive.

U.S. Pat. No. 5,163,580 to Beach et al. discloses a roofing washer-dispensing and fastener-driving machine which uses a rigid rod 38 with a head (not numbered) to push the stack of the washers downward. It is to be noted that, the size of the head connected to the rigid rod 38 is limited when compared with the size of the washers so that it has to be positioned in the center of the washers or the washers could be pushed off the central axial direction and cannot be provided as expected. This is important when the size of the washers is smaller than the interior of the magazine.

The present invention intends to provide a washer supply device wherein the pushing rod has an engaging head which is accurately engaged with a groove in a surface of each washer so that the washers are exerted an axial force and are ensured to be pushed along a desired path.

SUMMARY OF THE INVENTION

In accordance with one aspect of the present invention, there is provided a washer supply device and comprises a hollow tubular member connected to a side of a power nailer and an opening is defined longitudinally through the tubular member. A washer transferring member is connected to the power nailer and a lower end of the tubular member is rested on the washer transferring member. A hole is defined through the washer transferring member and communicates with an interior of the tubular member. A cap is connected to a top end of the tubular member and a pushing rod extends through the cap and an engaging head is connected to a lower end of the pushing rod so as to engage with a groove defined in a surface of each washer. A spring is mounted to the pushing rod and located between the cap and the engaging head. A flexible wire frictionally extends through the central holes of the stack of the washers. The washers are received in the tubular member via the opening and the wire is pulled out from the washers via the hole in the washer transferring member.

The primary object of the present invention is to provide a washer supply device wherein the washers are correctly pushed along the axial direction toward the washer transferring member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
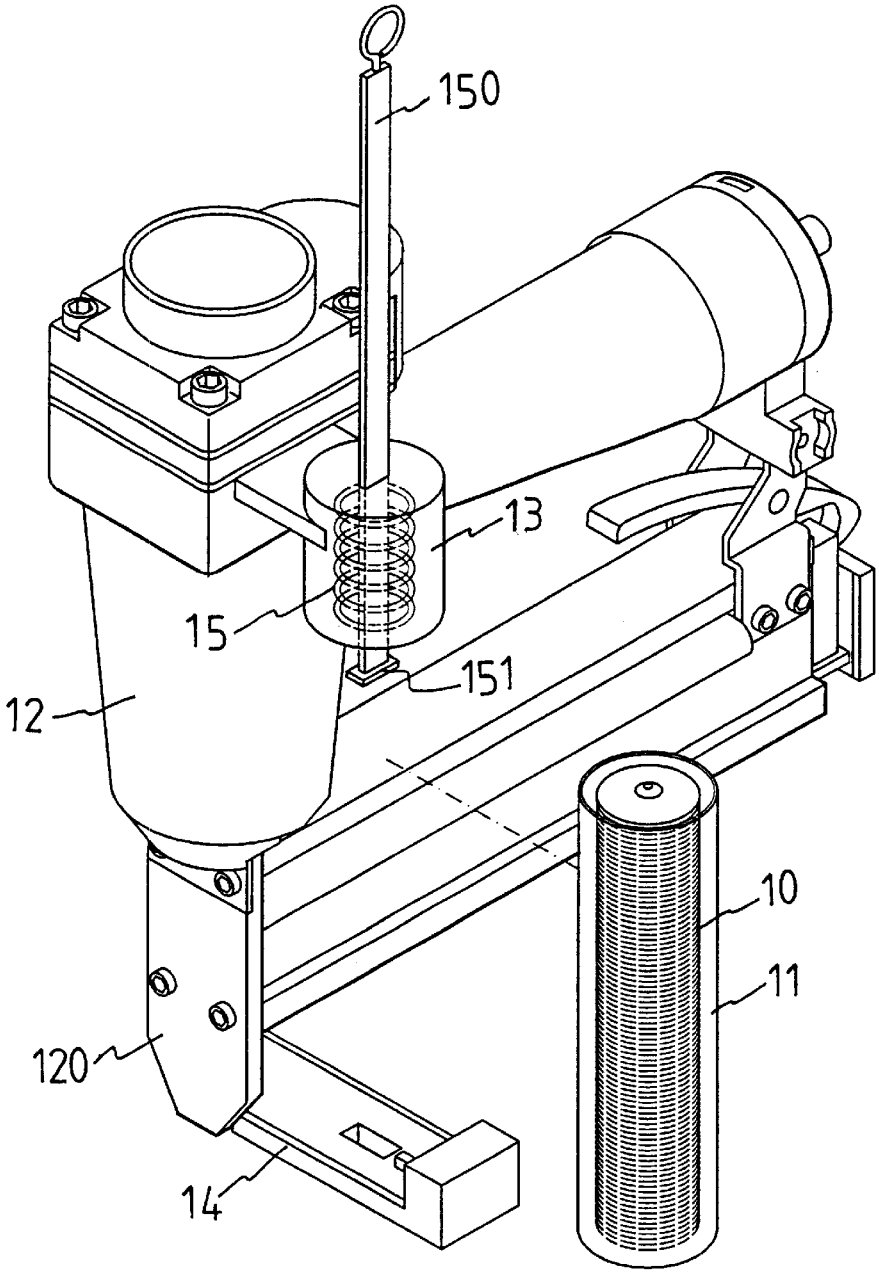
FIG. 1 PRIOR ART
FIG. 1 is an exploded view to show a conventional washer supply device for power nailers.
Figure 2:
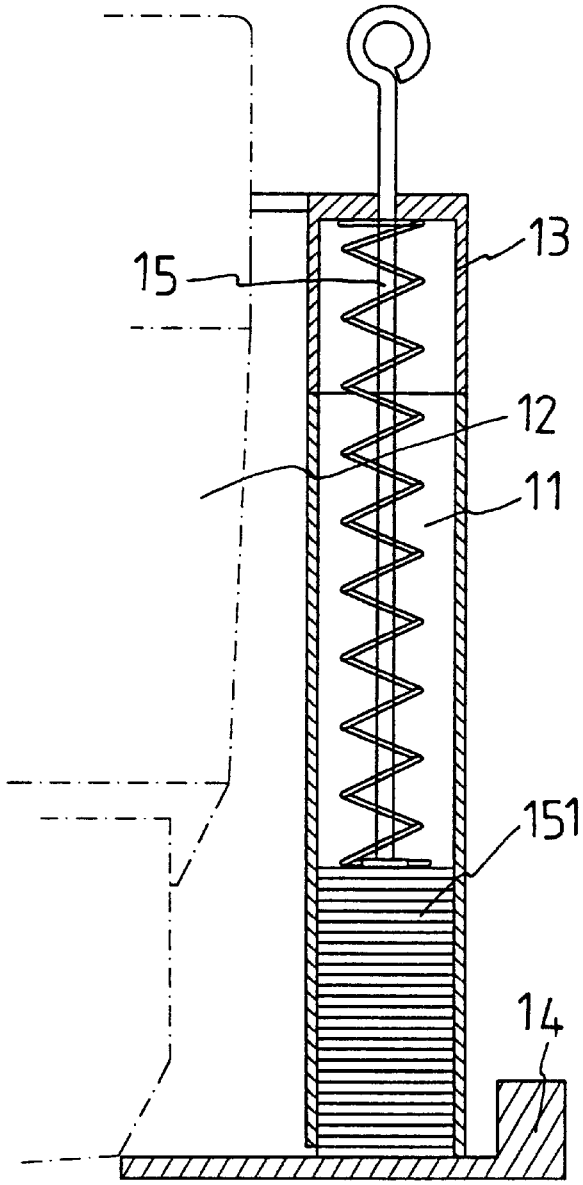
FIG. 2 PRIOR ART
FIG. 2 is a cross sectional view to show the conventional washer supply device.
Figure 3:
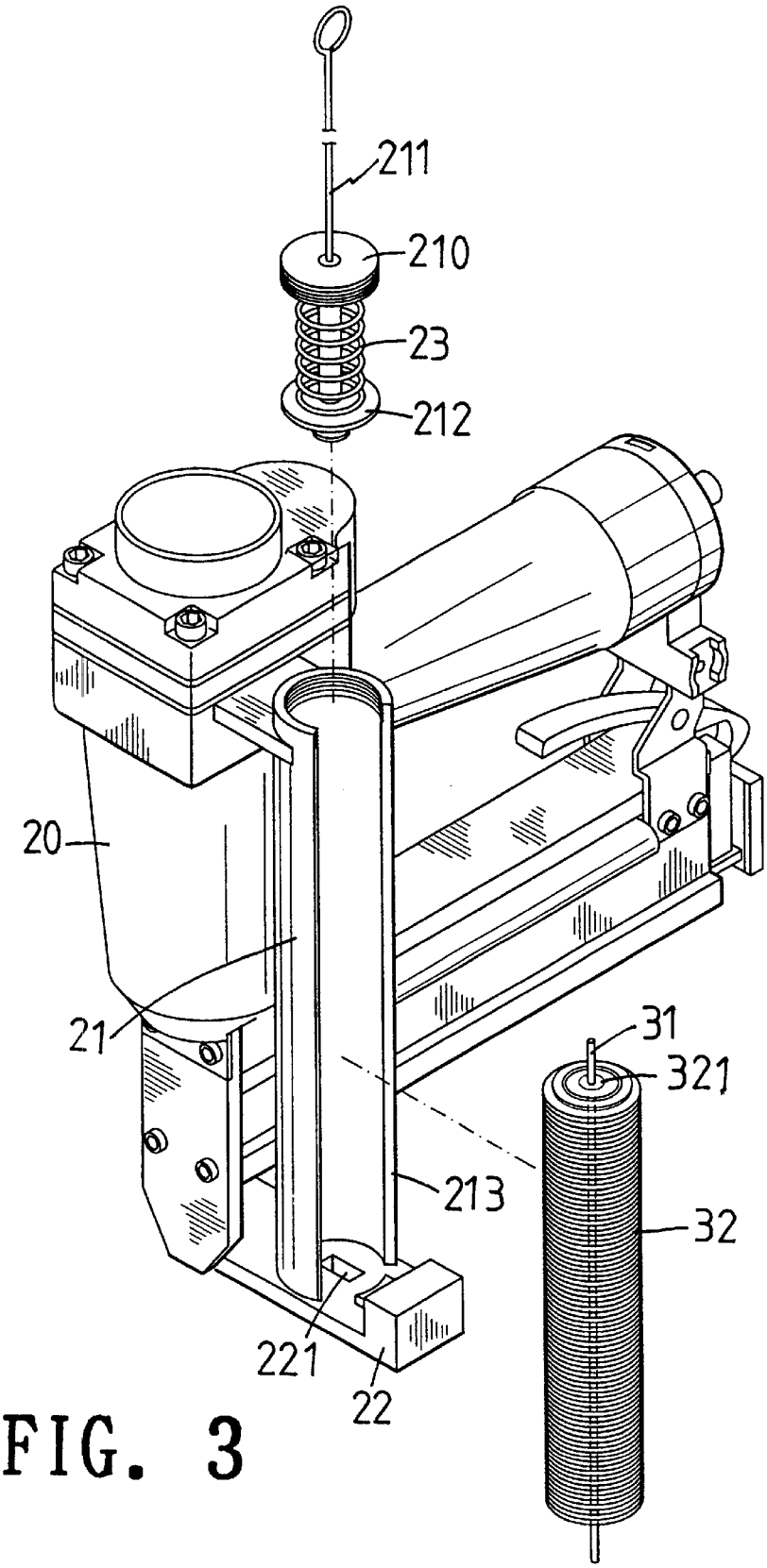
FIG. 3 is an exploded view to show a washer supply device of the present invention.
Figure 3A:
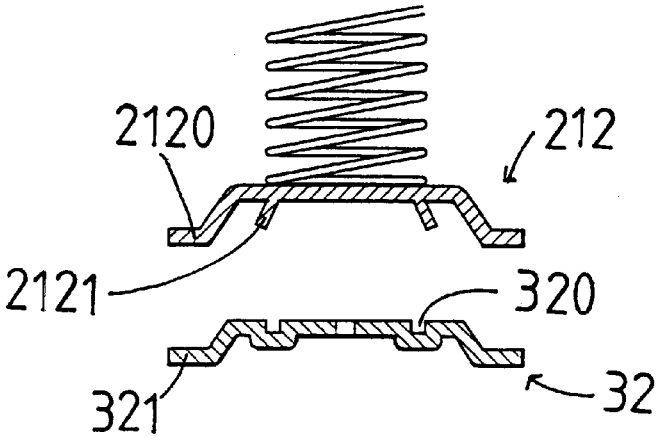
FIG. 3A shows the profile of the engaging head connected to the pushing rod and the groove of each of the washers.
Figure 3B:
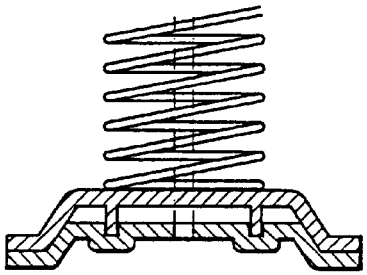
FIG. 3B shows the engaging head is matched with a washer.
Figure 4:
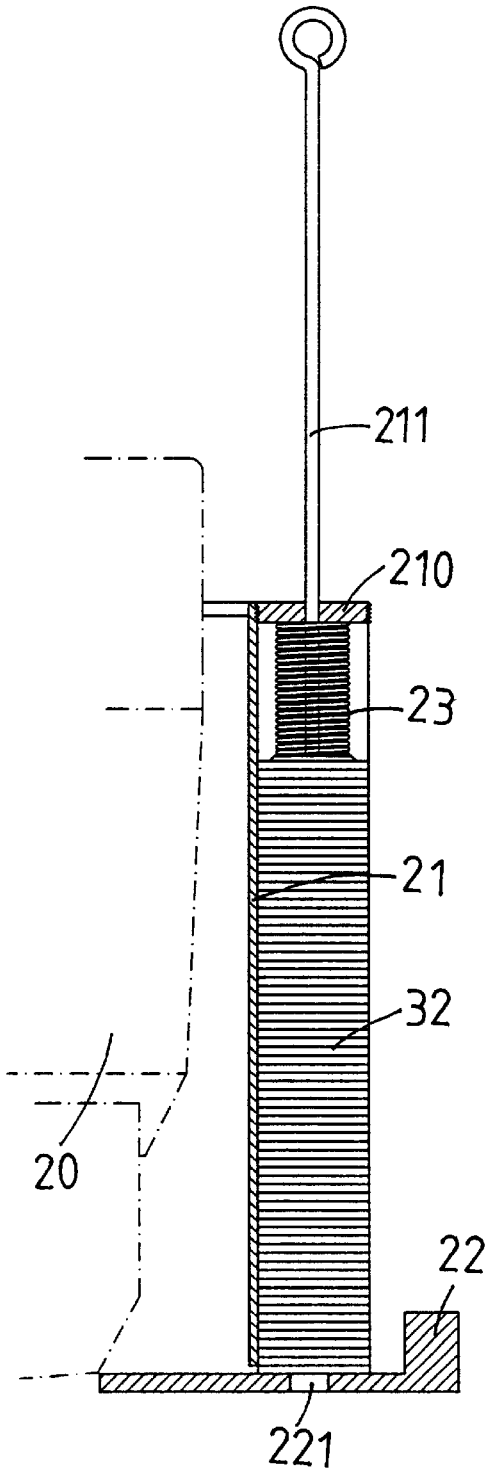
FIG. 4 is a cross sectional view to show the washer supply device of the present invention.
Figure 5:
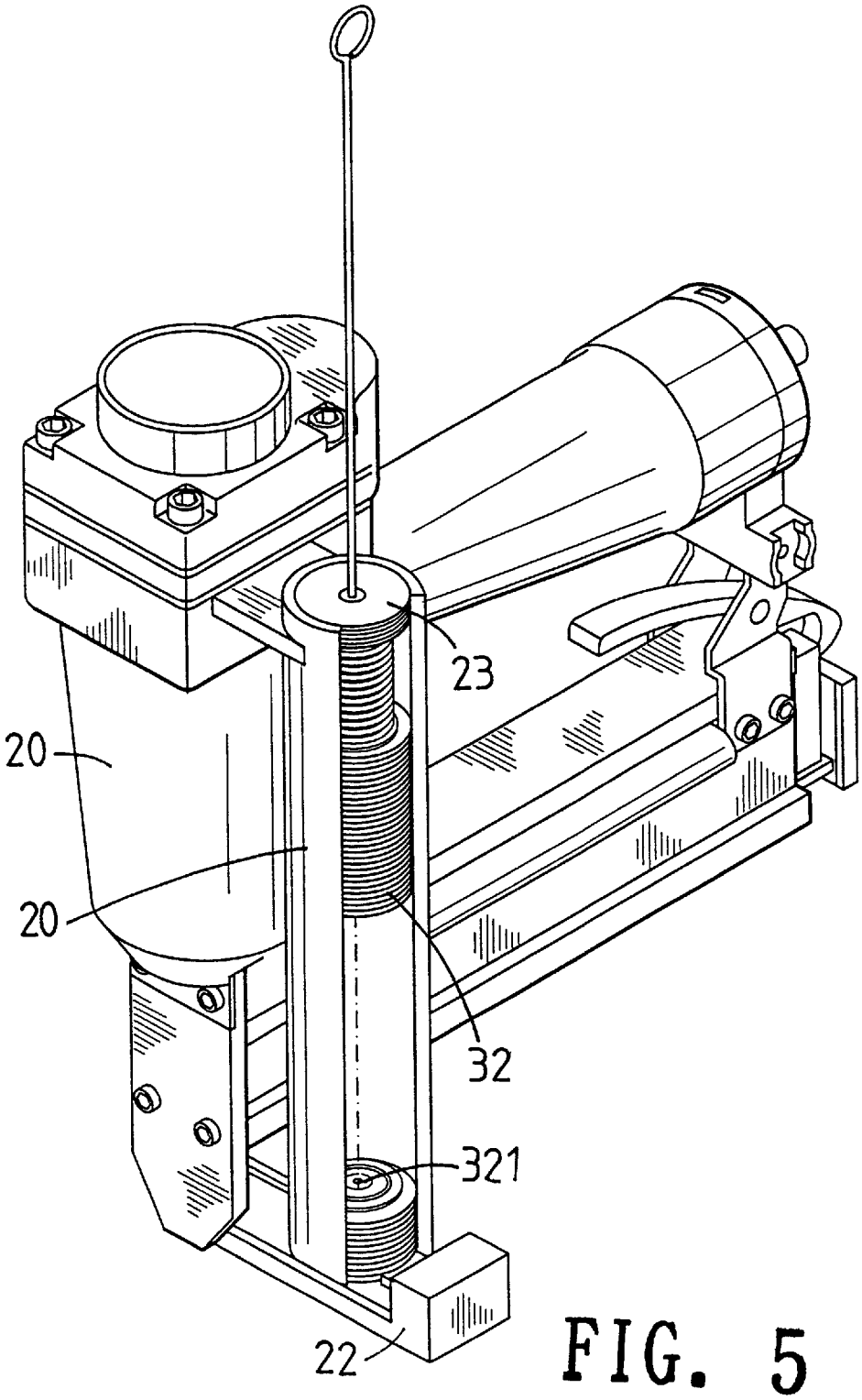
FIG. 5 is a perspective view to show the washer supply device of the present invention.

Referring to FIGS. 3, 4 and 5, the washer supply device for power nailers of the present invention comprises a hollow tubular member 21 which is connected to a side of a power nailer 20 and an elongated opening 213 is defined longitudinally through the tubular member 21. A washer transferring member 22 is connected to a nose portion of the power nailer 20 and a lower end of the tubular member 21 is rested on the washer transferring member 22. A hole 221 is defined through the washer transferring member 22 and communicates with an interior of the tubular member 21. A cap 210 is threadedly connected to a top end of the tubular member 21 and a pushing rod 211 extends through the cap 210. Further referring to FIGS. 3A and 3B, an engaging head 212 is connected to a lower end of the pushing rod 211 and a spring 23 mounted to the pushing rod 211 is located between the cap 210 and the engaging head 212.

A pile of washers 32 each have a central hole 321 and a flexible wire 31 frictionally extends through the central holes 321 so that the washers 32 are collected as a pile by the friction of the wire 31. An annular groove 320 is defined in a surface thereof. A peripheral flange 321 extends radially from an outer periphery of each washer 32. The pile of washers 32 is then received in the tubular member 21 via the opening 213, and the wire 31 is pulled out from the washers 32 via the hole 221 in the washer transferring member 22. The pile of washers 32 is pressed by the engaging head 212 and the lowest washer 32 will be sent in the washer transferring member 22. The engaging head 212 includes an outer portion 2120 which has a skirt portion extending downward so as to press on the peripheral flange 321 of each of the washer 32, and an inner portion 2121 which extends from an underside of the engaging head 212 and is designed to engage with an annular groove 321 defined in a surface of each washer 32. By this way, each washer 32 is double-secured by the engaging head 212 and is ensured to be pushed along the axial direction of the tubular member 21.

Figure 6:
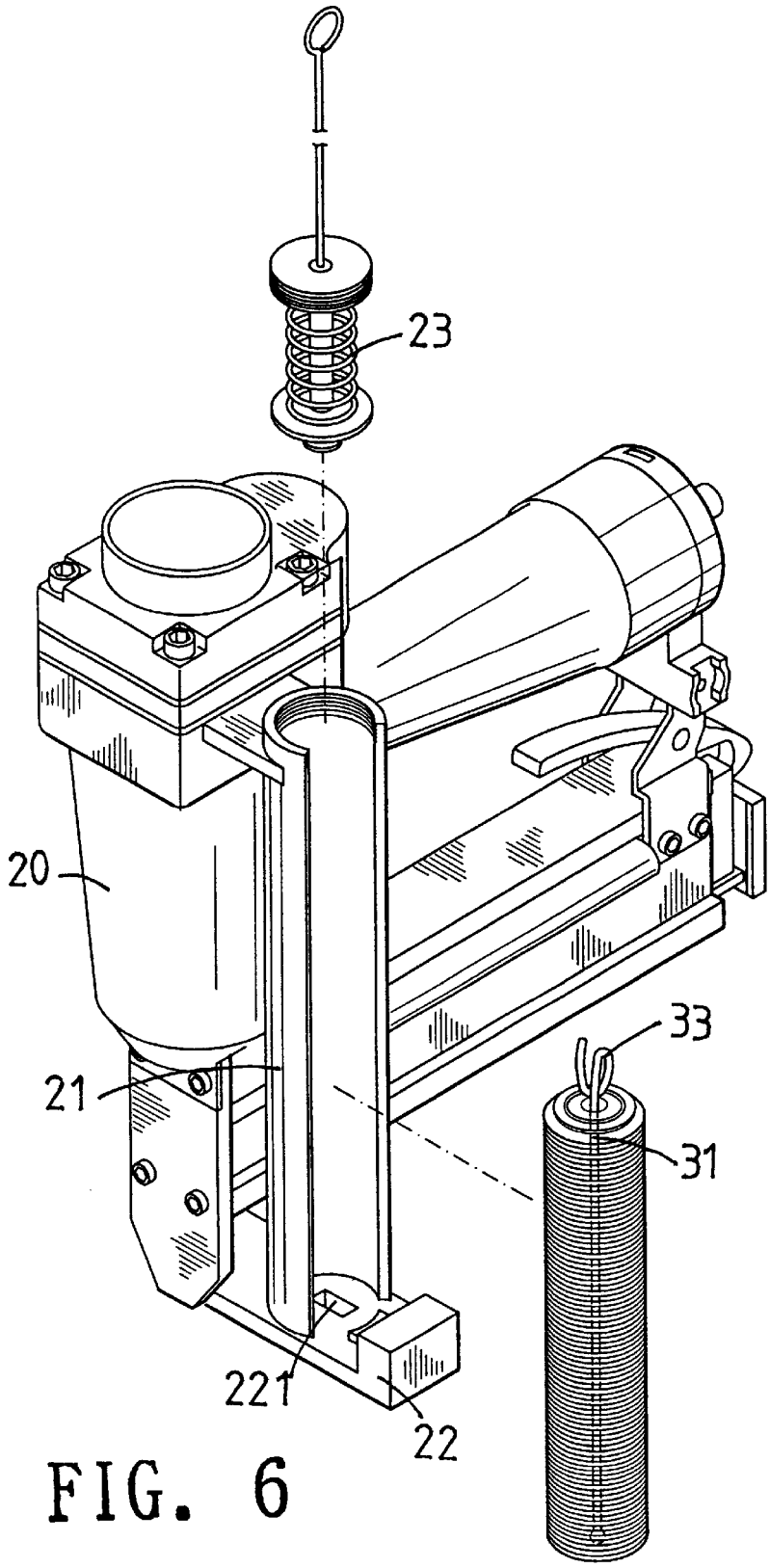
FIG. 6 is an exploded view to show another embodiment of the wire extending through washers.

FIG. 6 shows that the top end 33 of the wire 31 can be made to be a large head which applies a force to the pile of the washers 31 so that the pile washers 32 are conveniently collected together and carried.

Accordingly, even if the interior of the tubular member 21 is larger than the diameter of the washers 32, the washers 32 are pushed firmly along the axial direction and no washer 32 is pushed aside or inclined during feeding. This ensures that the washers 32 are provided constantly.

While we have shown and described various embodiments in accordance with the present invention, it should be clear to those skilled in the art that further embodiments may be made without departing from the scope and spirit of the present invention.

What is claimed is:

1. A washer supply device comprising:

a hollow tubular member adapted to be connected to a side of a power nailer and an opening defined longitudinally through said tubular member, a washer transferring member adapted to be connected to the power nailer and a lower end of said tubular member rested on said washer transferring member, a hole defined through said washer transferring member and communicating with an interior of said tubular member;

a cap detachably engaged with the hollow tubular member and a pushing rod extending through said cap and an engaging head connected to a lower end of said pushing rod, a spring mounted to said pushing rod and located between said cap and said pushing end, the engaging head including an outer portion which has a skirt portion extending downward, and an inner portion which extends from an underside of the engaging head, and a plurality of washers each having a central hole and a flexible wire frictionally extending through said central holes, said washers received in said tubular member via said opening, said wire being pulled out from said washers via said hole in said washer transferring member, an annular groove defined in a surface of each of said washer and being engaged with the inner portion of the engaging head, a peripheral flange extending radially from an outer periphery of each washer and being pressed by said skirt portion of said outer portion of said engaging head.

* * * * *